United States Patent [19]

Spanner

[11] 4,276,845

[45] Jul. 7, 1981

[54] ICE CUTTING AND BREAKING VESSEL

[76] Inventor: W. F. Spanner, 4 Albion Ter., The Common, Patchway, Bristol BS12 6AN, England

[21] Appl. No.: 67,452

[22] Filed: Aug. 17, 1979

[51] Int. Cl.[3] ..... B63B 35/08

[52] U.S. Cl. ..... 114/42; 299/26

[58] Field of Search ..... 9/14; 114/40, 41, 42, 114/125, 293, 56, 150, 151; 115/9, 11, 12 R, 12 A, 14, 15, 16; 299/24–28

[56] References Cited

U.S. PATENT DOCUMENTS

| | | | |
|---|---|---|---|
| 529,379 | 11/1894 | Hallett | 9/14 |
| 3,530,814 | 9/1970 | Rastorgueu | 114/40 |
| 3,670,681 | 6/1972 | Upchurch | 114/40 |
| 3,762,354 | 10/1973 | Waas | 114/41 |
| 3,850,125 | 11/1974 | Anders | 114/40 |
| 3,886,882 | 6/1975 | Thornburg | 114/40 |
| 3,985,091 | 10/1976 | Waas | 114/40 |
| 4,067,282 | 1/1978 | Guinn | 114/293 |
| 4,198,917 | 4/1980 | Oshima | 114/42 |

*Primary Examiner*—Trygve M. Blix
*Assistant Examiner*—D. W. Keen
*Attorney, Agent, or Firm*—Larson and Taylor

[57] ABSTRACT

An ice cutting and breaking vessel is disclosed for providing a shipping channel through an ice layer. The bow of the vessel is provided with a plurality of reciprocating cutting blades for cutting the ice into slabs. The slabs of ice slide under the bow and are pushed under the surrounding ice layer by a wedge-shaped prow depending from the bow and by water discharged laterally from the prow. The vessel is also provided with an emergency ballast tank, located above the water line, which can be quickly emptied through large ports. A pair of grapnels with attached cables may also be provided which are shot from the vessel. When the grapnel hits the ice layer, it pierces the ice and becomes wedged under the ice layer. Using the cables to pull on, the vessel can then haul itself toward the grapnels.

6 Claims, 8 Drawing Figures

ICE CUTTING AND BREAKING VESSEL

FIELD OF THE INVENTION

The present invention relates to an icebreaker vessel, and more specifically, to an icebreaker vessel using cutting blades on a boxlike forefront to cut the ice layer into slabs and having a prow which pushes the slabs of ice underneath the surrounding ice layer.

BACKGROUND OF THE INVENTION

Many different designs for icebreaker vessels have been disclosed in the prior art with various features to assist the ice breaking function of the vessel. For example, in U.S. Pat. Nos. 3,931,780 to Waas, and 3,530,814 to Rastorguev et al, a specially designed forecastle is disclosed which includes a wedge-shaped portion and water discharge devices to push broken ice under the surrounding ice layer. The Wass patent also discloses a square bow as well. Also disclosing a square front end and a prow and associated fins for directing broken ice under the surrounding ice layer is U.S. Pat. No. 3,636,904 to Blanchet.

In order to increase the ice breaking ability of ships, various means have been employed. One simple idea has been to merely increase the power output of the engines. Another idea, disclosed in U.S. Pat. No. 2,902,964 to Waas et al, is to provide an increased pitching motion for the icebreaker. Either by shifting water between fore and aft ballast tanks or by swinging weights, the downward breaking motion of the bow on the ice is increased. It has also been disclosed in U.S. Pat. No. 355,214 to Romaine to use reciprocating hammers on either end of a vessel to break or crush the ice into small pieces.

The prior art, however, has failed to provide for an efficient icebreaker which can be used for a variety of different ice thicknesses. In addition, prior art icebreakers simply act to crush the ice layer, which is inefficient and sometimes ineffective when thick ice is encountered.

SUMMARY OF THE PRESENT INVENTION

The present invention provides an icebreaker vessel for clearing a channel through a layer of ice. The icebreaker is equipped with a boxlike forefront extending over the ice layer carrying a plurality of cutting blades which cut the ice layer in the path of the icebreaker into slabs. The slabs of ice then slide below a flat bow portion and under the water. As the slabs slide further along the bow portion, a depending prow and a stream of water push the slabs underneath the surrounding ice layer. The icebreaker is also equipped with an emergency ballast tank to free the icebreaker if it becomes stuck in the ice. The emergency ballast tank is located above water level and is quickly emptied through large openings to rapidly alter the trim of the icebreaker and thus free it from surrounding ice.

When clearing a path through particularly thick ice, the power supplied by the engines may not be sufficient to push the icebreaker through the ice. In this case, the icebreaker is provided with a grapnel and cable which are launched ahead of the icebreaker. The grapnel pierces the ice layer and becomes wedged underneath the ice layer. By pulling on the cable and using the propellers, the icebreaker can be hauled through the thick ice to the grapnel. The grapnel is then retrieved and the process is repeated as many times as necessary in order to haul the vessel through the thick ice.

Additional features and advantages of the present invention are apparent from, or will be set forth in, the detailed description of the preferred embodiment found hereinbelow.

DETAILED DESCRIPTION OF THE PREFERRED EMBODIMENT

Figure 1:
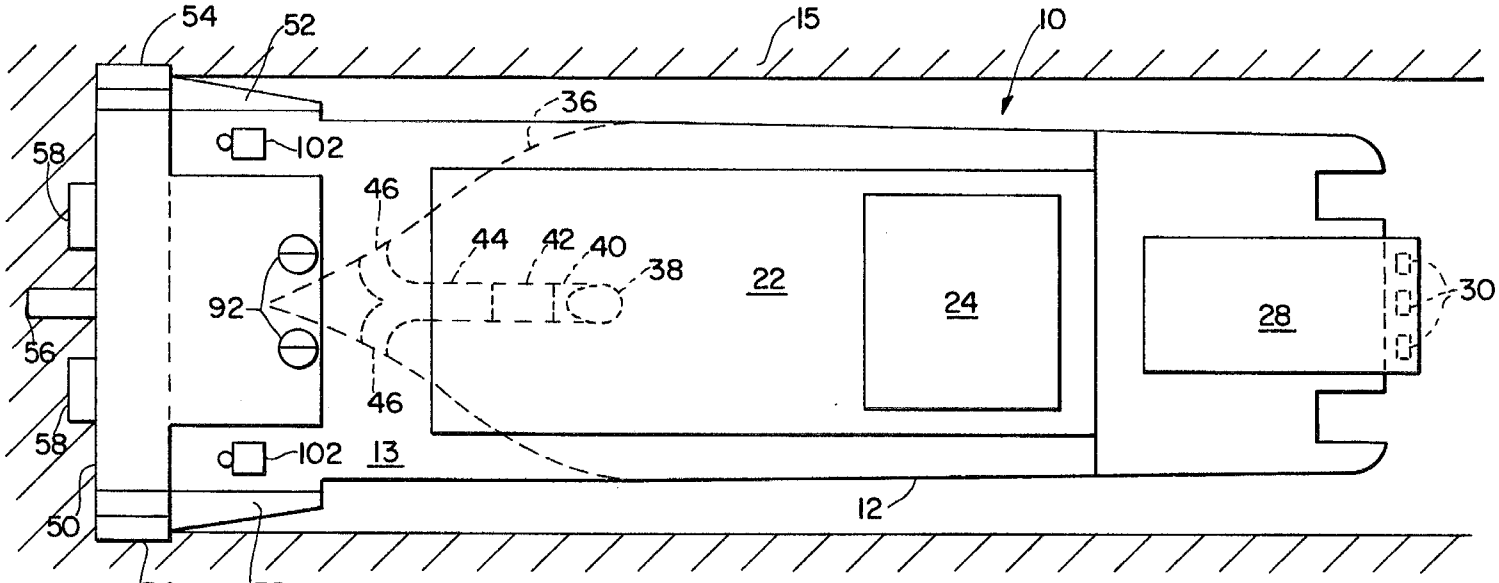
FIG. 1 is a schematic top view of a preferred embodiment of the icebreaker vessel of the present invention.
Figure 2:
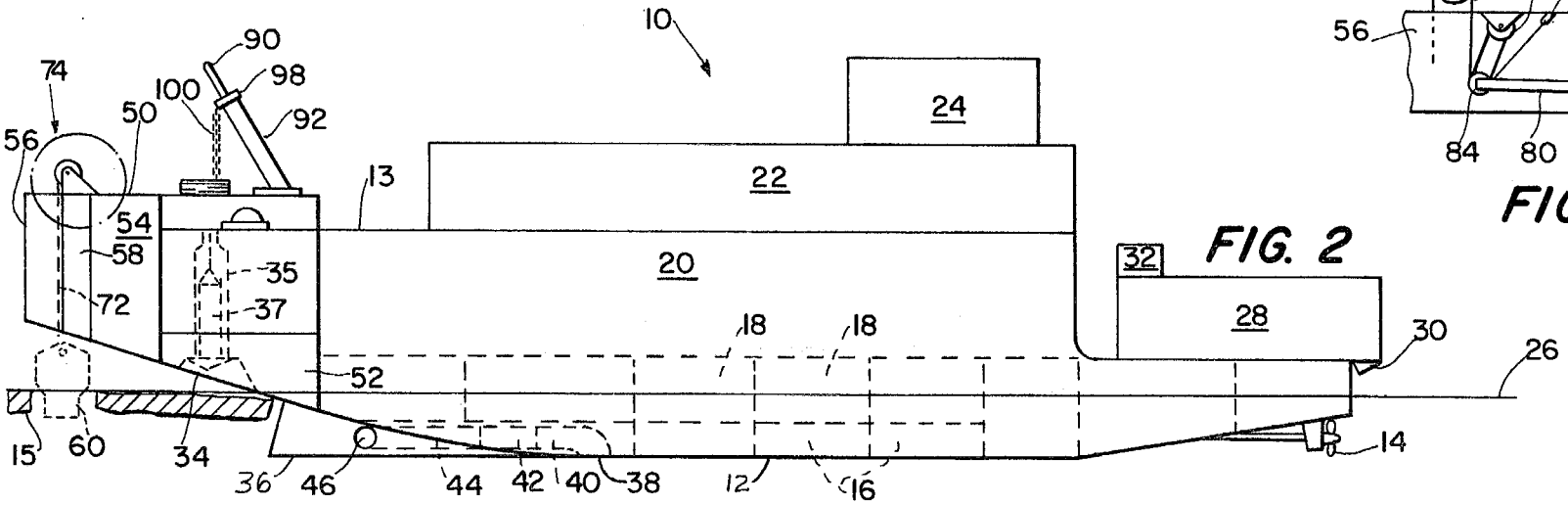
FIG. 2 is a schematic side view of the icebreaker vessel depicted in FIG. 1.

With reference to the drawings in which like numerals represent like elements throughout the several views, a presently preferred embodiment of the invention is depicted in FIGS. 1 and 2 and comprises an icebreaker vessel 10 which is surrounded by an ice layer 15 having a hull 12, a deck 13, and a propeller 14. The lower half of hull 12 is divided into storage compartments 16 and ballast tanks 18. Above storage compartments 16 is an area 20 in which hydraulic pumping equipment, engines, generators, bilge pumps, and the like are housed. Located above room 20 is another area 22 containing cabins, galley, dining area and the like. Finally, on top of area 22 is a chartroom 24.

In the water, icebreaker 10 has a waterline 26. Located at the stern of icebreaker 10 is an emergency ballast tank 28. Emergency ballast tank 28 is located above water line 26 so that it can be quickly emptied through large valved openings 30 directly into the surrounding water. A fuel tank 32 is conveniently placed on top of emergency ballast tank 30.

Figure 4:
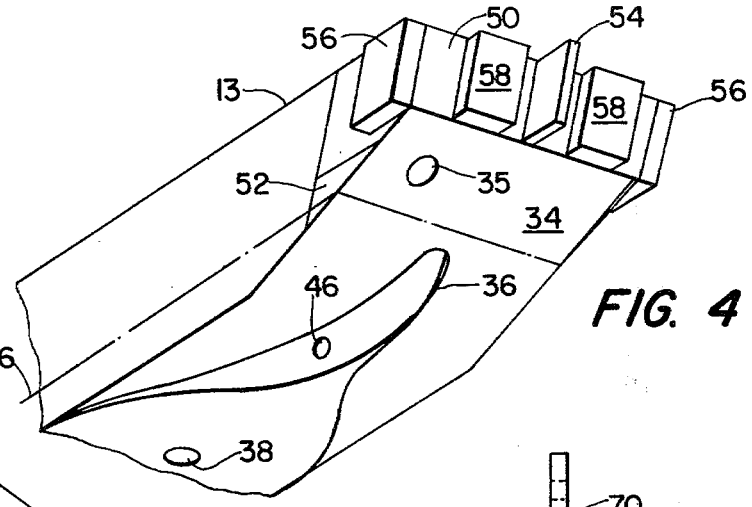
FIG. 4 is a schematic perspective view of the bow portion of the present invention.

As also shown in FIG. 4, hull 12 of icebreaker 10 has a bow portion 34 which is generally planar. Bow portion 34 has an anchor recess 35 located above waterline 26 so that an anchor 37 is fully withdrawn into bow portion 34. Depending from bow portion 34 is a prow 36. Prow 36 forms a wedge shaped keel, widening gradually toward the stern until it finally merges with bow portion 34. Located along the bottom of hull 12 is an intake port 38 and pipe 40 through which water is drawn by a pump 42. The water is discharged from pump 42 and travels through a pipe 44 to orifice 46 located on each side of prow 36. Orifice 46 directs the discharged water laterally along the bow portion 34.

At the end of the bow of icebreaker 10, a rectangular forefront 50 extends out over the ice layer 15. Forefront 50 is wider than hull 12 and conveniently built in the form of a box girder. Rigidly attached on either side of forefront 50 is a pair of reinforcing panels 52. Reinforcing panels 52 extend below water line 26 and are used as renewable rubbing or chafing pads. Preferably, reinforcing panels 52 are made of timber with steel sheeting.

Figure 5:
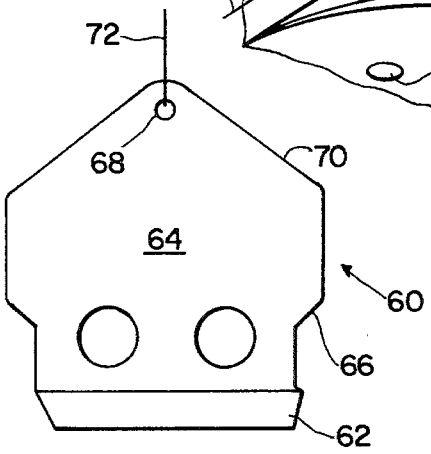
FIG. 5 is a front view of a cutting blade used to split the ice layer into slabs.
Figure 6:
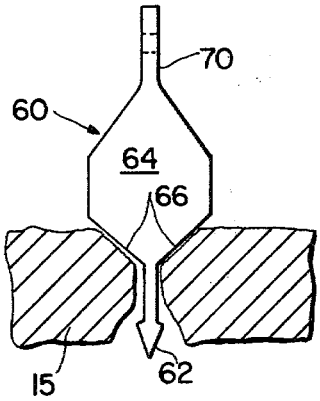
FIG. 6 is a side view of the cutting blade of FIG. 5 which has split the ice layer.

Rigidly attached to forefront 50 are two longitudinal side guides 54, a longitudinal center guide 56, and two lateral guides 58. Each of the elongate guides 54, 56 and 58 has a hollow rectangular cross-section so as to form a vertical sleeve in which an elongate cutting blade 60 is received. As shown in more detail in FIGS. 5 and 6, cutting blade 60 has a blade portion 62 projecting from a blade body 64 having tapered shoulders 66. At the end opposite blade portion 62, a hole 68 is located in the center of a tapered projection 70 to which a lifting cable 72 is attached.

Figure 3:
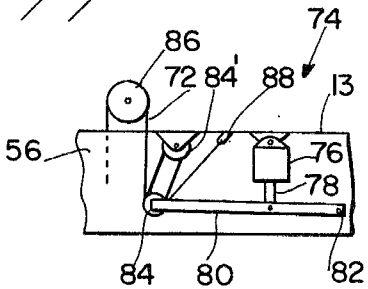
FIG. 3 is an enlarged view of the portion of FIG. 2 depicting one means for raising and lowering the cutting blades of the present invention.

Each blade 60 is reciprocated into and out of ice layer 15 by a suitable raising and lowering means. Many types of raising and lowering means are suitable for this purpose, including pneumatic, hydraulic, electric and combustion engines. One type of raising and lowering device 74, depicted in FIG. 3, can be used to raise and lower cutting blade 60 into and out of longitudinal center guide 56. It consists of a hydraulic motor 76 attached to deck 13 with an extendable piston rod 78. Piston rod 78 is pivotally connected to a lever 80 which is held stationary at one end around a pivot point 82. At the other end of lever 80 is a pulley 84. Above pulley 84 is another pulley 84' which is attached to deck 13. Projecting over longitudinal center guide 56 is a sheave 86 attached to forefront 50. Lifting cable 72 runs from cutting blade 60, up through longitudinal center guide 56, around sheave 86, between pulleys 84 and 84' one or more times, and is finally attached to deck 13 at a point 88.

Figure 7:
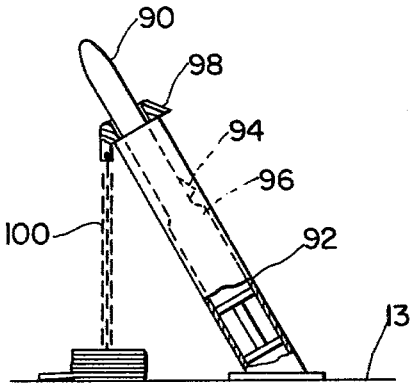
FIG. 7 is a schematic side view of a grapnel and grapnel launcher on the deck of the icebreaker vessel.
Figure 8:
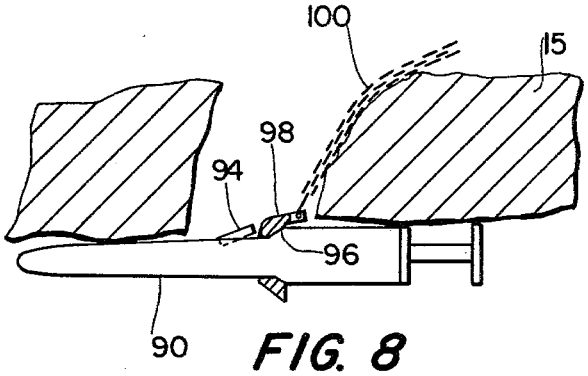
FIG. 8 is a schematic view of the grapnel of FIG. 7 wedged under an ice layer.

Icebreaker 10 also has a pair of pneumatic grapnel launchers 92 located on deck 13 near the bow. As shown in more detail in FIGS. 7 and 8, a grapnel 90 is placed in grapnel launcher 92 and is launched so as to pierce ice layer 15 and become wedged thereunder. Grapnel 90 is formed with a pawl 94 in front of an enlarged shoulder 96. A ring 98 is slipped over grapnel 90 as shown in FIG. 7 so that it is held between pawl 94 and shoulder 96 after grapnel 90 has been fired. A length of steel cable 100 is attached at one end to ring 98 and at the other end to a windlass 102.

In operation, icebreaker 10, with anchor 37 raised out of the way in anchor recess 35, functions in the following manner. Icebreaker 10 is about 122 feet long, has an overall beam of 42 feet, and displaces about 420 tones at a six foot draft. During conditions of a relatively thin ice layer 15, ballast tanks 18 are adjusted so that bow portion 34 plows into ice layer 15. The thrust provided by propeller 14 is enough to cause bow portion 34 to break the relatively thin ice into small pieces. However, when relatively thick ice is encountered by icebreaker 10, up to about two feet three inches thick, the thrust of propeller 14 is not enough to push bow portion 34 forward, breaking ice layer 15.

In order to proceed through thicker ice conditions, icebreaker 10 uses reciprocated cutting blades 60 to chop the oncoming ice into blocks. These ice blocks are formed as cutting blades 60, weighing approximately three tons, are lowered or dropped out of the various guides 54, 56 and 58. Even though cutting blades 60 are free to rotate about their respective lifting cable 72, each cutting blade 60 stays approximately aligned with the particular guide 54, 56 or 58 from which it is dropped or lowered. Thus, cutting blades 60 dropped from longitudinal side and center guides 54 and 56 split ice layer 15 in a longitudinal direction. Likewise, cutting blades 60 dropped from lateral guides 58 split ice layer 15 in the lateral direction. In combination, it is easily seen that the result of the action of all cutting blades 60 is to split ice layer 15 lying below forefront 50 continuous into two large blocks. As it is cut, each block of ice slides underneath the approaching generally planar configuration of bow portion 34 until the blocks contact prow 36. Upon contacting prow 36, the blocks of ice are pushed outward and underneath the surrounding ice layer 15, leaving a cleared channel of approximately forty feet through ice layer 15. To further enhance the action of prow 36, pump 42 draws water through intube port 38 located below the hull. This water is discharged laterally along bow portion 34 through orifices 46 on either side of prow 36 so as to help push ice blocks under the surrounding ice layer 15.

Raising and lowering device 74 functions in the following manner. Cutting blade 60 is normally held in the raised position inside of longitudinal center guide 56. Cutting blade 60 is held in this position by the action of piston rod 78 of hydraulic motor 76 being kept in its extended position. Piston rod 78 holds lever 80 at its lowermost position, which causes pulleys 84 and 84' to be in their most separated position. This means that lifting cable 72, attached at one end to point 88, spans the maximum separated distance of pulleys 84 and 84'. Thus, the length of lifting cable 72 overhanging sheave 86 and attached to cutting blade 60 is at a minimum. Cutting blade 60 is dropped from guide 56 when piston rod 78 is suddenly released from its extended position. As this happens, lever 80 moves upwards due to the force exerted on pulley 84 by lifting cable 72 attached to cutting blade 60. Pulleys 84 and 84' then move closer together and the length of cable 72 overhanging sheave 86 is then increased by the same length of cable 72 that was reduced between pulleys 84 and 84'. The result is that cutting blade 60 falls under the action of gravity into ice layer 15, splitting ice layer 15. While cutting blade 60 is free to rotate, it maintains approximately the same orientation that it had when it fell from guide 56. Cutting blade 60 is raised by supplying power to hydraulic motor 76 to cause piston rod 78 to move to its extended position. This raises cutting blade 60 back into guide 56 and cutting blade 60 is then aligned and ready to be dropped again.

If icebreaker 10 becomes stuck in ice layer 15, emergency ballast tank 28 is used to break icebreaker 10 free. Emergency ballast tank 28 is rapidly emptied of water through openings 30 into the surrounding water. By locating emergency ballast tank 28 at the stern of icebreaker 10, the emptying of emergency ballast tank 28 causes a significant change in the trim of icebreaker 10. This change of trim causes bow portion 34 to bear down on the surrounding ice layer with increased force, smashing the ice beneath bow portion 34 and thus breaking icebreaker 10 free from the surrounding ice layer.

During operation of icebreaker 10, there may also be times when the thrust from propeller 14 is not enough to propel icebreaker 10 forward through an especially thick patch of ice. At such times, grapnel 90 is fired ahead of icebreaker 10 by grapnel launcher 92. As grapnel 90 leaves grapnel launcher 92, ring 98 passes over pawl 94 and is trapped between pawl 94 and shoulder 96. Thus, as grapnel 90 travels ahead of icebreaker 10, it is connected to icebreaker 10 by steel wire 100. When grapnel 90 hits ice layer 15, it passes through ice layer 15. The end of steel wire 100, attached to windlass 102, is reeled in until grapnel 90 is wedged below ice layer 10. Then, by adding the pull of windlass 102 on steel cable 100 to the thrust of propeller 14, icebreaker 10 can move forward as cutting blades 60 cut ice layer 15 into blocks.

The embodiment of icebreaker 10 described above is designed for use in relatively open bodies of water. A smaller version of the above embodiment can be adapted for use in smaller bodies of water. In such a case, where added mobility, or a shorter turning radius is desired, longitudinal side guides 56 can be moved slightly further apart so that a wider channel is cut. Alternatively, auxiliary longitudinal side guides (with associated cutting blades and raising and lowering devices) can be positioned behind longitudinal side guides 54 but extending transversely outward farther than longitudinal guides 54. When used, the auxiliary longitudinal side guides direct their associated cutting blades to chop a slightly wider channel, giving the shorter icebreaker more room to maneuver.

It may also be advantageous to provide icebreaker 10 with a pitching motion. A variety of methods to achieve this motion are known in the prior art. A suitable method for use with this invention is a moving weight. By providing a passageway in the center of the icebreaker from stem to stern, a heavy weight on a rail car or the like could be shifted repeatedly forward and aft by winches to cause this pitching motion.

Although the invention has been described in detail with respect to exemplary embodiments thereof, it will be understood by those of ordinary skill in the art that variations and modifications may be effected within the scope and spirit of the invention.

I claim:

1. An icebreaker vessel including a hull for clearing a channel through an ice layer comprising:

a rectangular forefront, extending out over the ice layer, which is wider than the hull;

a plurality of elongate hollow guides attached to said forefront and extending in a vertical direction, said guides being located above the water line;

a corresponding plurality of cutting blades, each of said blades disposed respectively in one of said guides;

means for lowering said blades into the ice layer and raising said blades back into said corresponding guides;

a bow portion extending downward and aft in a generally planar configuration from said forefront to the hull, said bow portion being substantially rectangular in vertical cross section;

a prow, depending from said bow portion and forming a wedge-shaped keel, said prow widening gradually to merge with said bow portion;

means, including orifices located on the port and starboard sides of said prow, for discharging water laterally along the bottom of said bow portion; and an emergency water ballast tank, located above the water line at the aft end of the vessel, which is quickly emptied through large ports;

such that as the icebreaker travels through an ice layer, said cutting blades break the ice layer into pieces which slide below said bow portion and are then pushed under the surrounding ice layer by said prow and said water discharging means.

2. An icebreaker vessel as claimed in claim 1, wherein said cutting blades and said corresponding guides are arranged to split the ice layer in the longitudinal direction by means of one said cutting blade located on either side of said forefront and another said cutting blade located in the center of said forefront, the ice layer further being split in the transverse direction by means of said cutting blades on either side of said cutting blade located in the center of said forefront.

3. An icebreaker vessel as claimed in claim 1, further including a grapnel which is projected ahead of the vessel through the air and pierces the ice layer;

a cable having one end attached to said grapnel and the other end attached to the vessel above the water line; and means, located on the vessel, for hauling the vessel toward said grapnel by pulling on said attached cable.

4. An icebreaker vessel as claimed in claim 1, wherein the icebreaker vessel has an anchor and further including an anchor recess located above the water line in said bow portion such that the anchor is stowed in said anchor recess fully within said bow portion and clear of the ice layer.

5. An icebreaker vessel as claimed in claim 1 further including reinforcements located on either side of said bow portion such that during operation the sides of said bow portion are protected from damage by the unbroken ice layer.

6. An icebreaker vessel including a hull for clearing a channel through an ice layer comprising:

a bowlike forefront, extending out over the ice layer, which is wide than the hull;

a bow portion extending downward and aft in a generally planar configuration from said forefront to the hull, said bow portion being substantially rectangular in vertical cross-section;

a prow, depending from said bow portion and forming a wedge-shaped keel, said prow widening gradually to become continuous with said bow portion;

means, including orifices located on the port and starboard sides of said prow, for discharging water laterally along the bottom of said bow portion;

an emergency water trim tank, located above the water line, which is quickly emptied through large ports;

a plurality of cutting blades located above the water line and adapted to split the ice layer;

means for reciprocating said cutting blades into and out of the ice layer below said forefront so that the ice layer is split longitudinally at each side and at the center of said forefront as well as being split laterally between each longitudinal side split and the center split;

a grapnel;

a cable having one end attached to said grapnel and the other end attached to the vessel above the water line;

means for launching said grapnel away from the icebreaker so that said grapnel pierces the ice layer and becomes wedged under the ice layer; and means, located on the icebreaker, for hauling the icebreaker towards said grapnel using said cable;

such that as the icebreaker travels through an ice layer, said cutting blades split the ice layer into blocks which slide below said bow portion and are pushed under the surrounding ice layer by said prow and said water discharging means.

* * * * *